US011089821B2

(12) United States Patent
Liu

(10) Patent No.: US 11,089,821 B2
(45) Date of Patent: Aug. 17, 2021

(54) ELECTRONIC CIGARETTE

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 309 days.

(21) Appl. No.: 16/380,984

(22) Filed: Apr. 10, 2019

(65) Prior Publication Data

US 2020/0178614 A1 Jun. 11, 2020

(30) Foreign Application Priority Data

Dec. 10, 2018 (CN) ..... 201811501326.7
Dec. 10, 2018 (CN) ..... 201822059558.3

(51) Int. Cl.
*A24F 13/00* (2006.01)
*A24F 47/00* (2020.01)
*A24F 7/02* (2006.01)

(52) U.S. Cl.
CPC ..... *A24F 47/008* (2013.01); *A24F 7/02* (2013.01)

(58) Field of Classification Search
CPC ..... A24F 47/00
USPC ..... 131/328–329
See application file for complete search history.

(56) References Cited

U.S. PATENT DOCUMENTS

2017/0231279 A1* 8/2017 Watson ..... H01M 50/213 131/329

* cited by examiner

*Primary Examiner* — Phuong K Dinh
(74) *Attorney, Agent, or Firm* — Matthias Scholl P.C.; Matthias Scholl

(57) ABSTRACT

An electronic cigarette, including a mouthpiece assembly, an atomizing assembly, and a base assembly. The mouthpiece assembly includes a mouthpiece, a first seal ring adapted to seal the mouthpiece, a cylinder, a protective cover, a pin, and a slide block. The atomizing assembly includes a silicone seal, a silicone ring, a housing, a threaded connection ring, an atomization unit, a sealing element adapted to seal the atomization unit, a second seal ring adapted to seal the sealing element, a glass tube, and a third seal ring adapted to seal the upper part of the glass tube. The base assembly includes a fourth seal ring, a support adapted to support the glass tube, a vapor regulating ring, a base, a fifth seal ring adapted to seal the vapor regulating ring, a sixth seal ring adapted to seal the base, an insulation ring, and a joint.

3 Claims, 6 Drawing Sheets

ELECTRONIC CIGARETTE

CROSS-REFERENCE TO RELAYED APPLICATIONS

Pursuant to 35 U.S.C. § 119 and the Paris Convention Treaty, this application claims foreign priority to Chinese Patent Application No. 201811501326.7 filed Dec. 10, 2018, and to Chinese Patent Application No. 201822059558.3 filed Dec. 10, 2018. The contents of all of the aforementioned applications, including any intervening amendments thereto, are incorporated herein by reference.

BACKGROUND

This disclosure relates to an electronic cigarette.

Electronic cigarettes atomize nicotine-containing e-liquid.

Conventional electronic cigarettes are not very robust and degrade quickly with use.

SUMMARY

The disclosure provides an electronic cigarette which is durable and comprises an e-liquid inlet that is reliably sealed.

Provided is an electronic cigarette, comprising a mouthpiece assembly, an atomizing assembly, and a base assembly. The mouthpiece assembly is disposed on the atomizing assembly. The atomizing assembly is disposed on the base assembly.

The mouthpiece assembly comprises a mouthpiece, a first seal ring adapted to seal the mouthpiece, a cylinder, a protective cover, a pin, and a slide block. The atomizing assembly comprises a silicone seal, a silicone ring, a housing, a threaded connection ring, an atomization unit, a sealing element adapted to seal the atomization unit, a second seal ring adapted to seal the sealing element, a glass tube, and a third seal ring adapted to seal an upper part of the glass tube. The base assembly comprises a fourth seal ring adapted to seal a lower part of the glass tube, a support adapted to support the glass tube, a vapor regulating ring, a base, a fifth seal ring adapted to seal the vapor regulating ring, a sixth seal ring adapted to seal the base, an insulation ring, and a joint.

The mouthpiece assembly is disposed on the atomizing assembly; the atomizing assembly is disposed on the base assembly; the pin is mounted in the protective cover; the first seal ring is sheathed on the mouthpiece; the protective cover comprises a central hole and the cylinder is disposed in the central hole; the slide block is embedded in the protective cover; the mouthpiece is inserted in the cylinder; the protective cover is flexibly sheathed on the cylinder; the housing comprises a top surface towards the mouthpiece assembly, and the silicone seal and the silicone ring are disposed on the top surface; the second seal ring is sheathed on the sealing element, and the sealing element is disposed in the threaded connection ring; the atomization unit is screwed on the threaded connection ring; the threaded connection ring is inserted in the housing; the glass tube is disposed in the housing, and the third seal ring is embedded in the top surface of the housing; the top surface of the housing comprises a sliding rail and the slide block is disposed on the sliding rail; the slide block is limited on the top surface of the housing via the pin; the fourth seal ring is sheathed on the support to fix and seal the glass tube; the fifth seal ring and the sixth seal ring are disposed in the base; the vapor regulating ring is disposed on the base; a lower part of the support is embedded in the base; the insulation ring is sheathed on the joint, and the joint is disposed on the base.

The mouthpiece, the protective cover, and the housing can be of stainless steel.

The support, the base, the atomization unit, and the housing can be in threaded connection.

Advantages of the electronic cigarette according to embodiments of the disclosure are summarized as follows. The protective cover can move up and down along the cylinder. To refill the atomization unit, the protective cover can be rotated upwards, and the slide block is pushed to one side. The e-liquid inlet of the atomizing assembly is exposed, and the e-liquid can be injected. After refilling, the slide block is pushed back and the protective cover descends to seal the e-liquid inlet. The mouthpiece, the protective cover, and the housing are of stainless steel.

DETAILED DESCRIPTION

To further illustrate, embodiments detailing an electronic cigarette are described below. It should be noted that the following embodiments are intended to describe and not to limit the disclosure.

Figure 1:
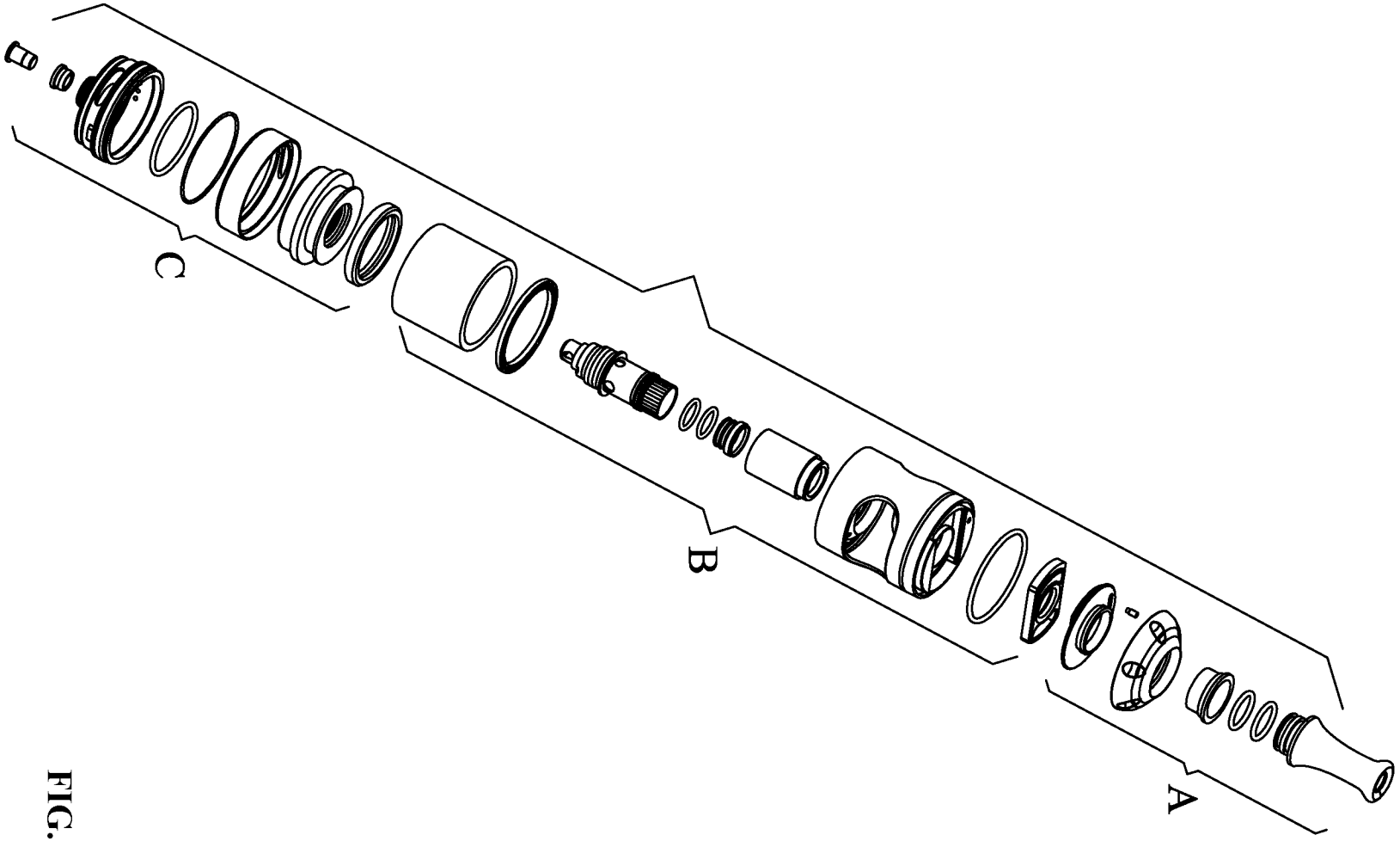
FIG. 1 is an exploded view of an electronic cigarette as described in the disclosure.
Figure 2:
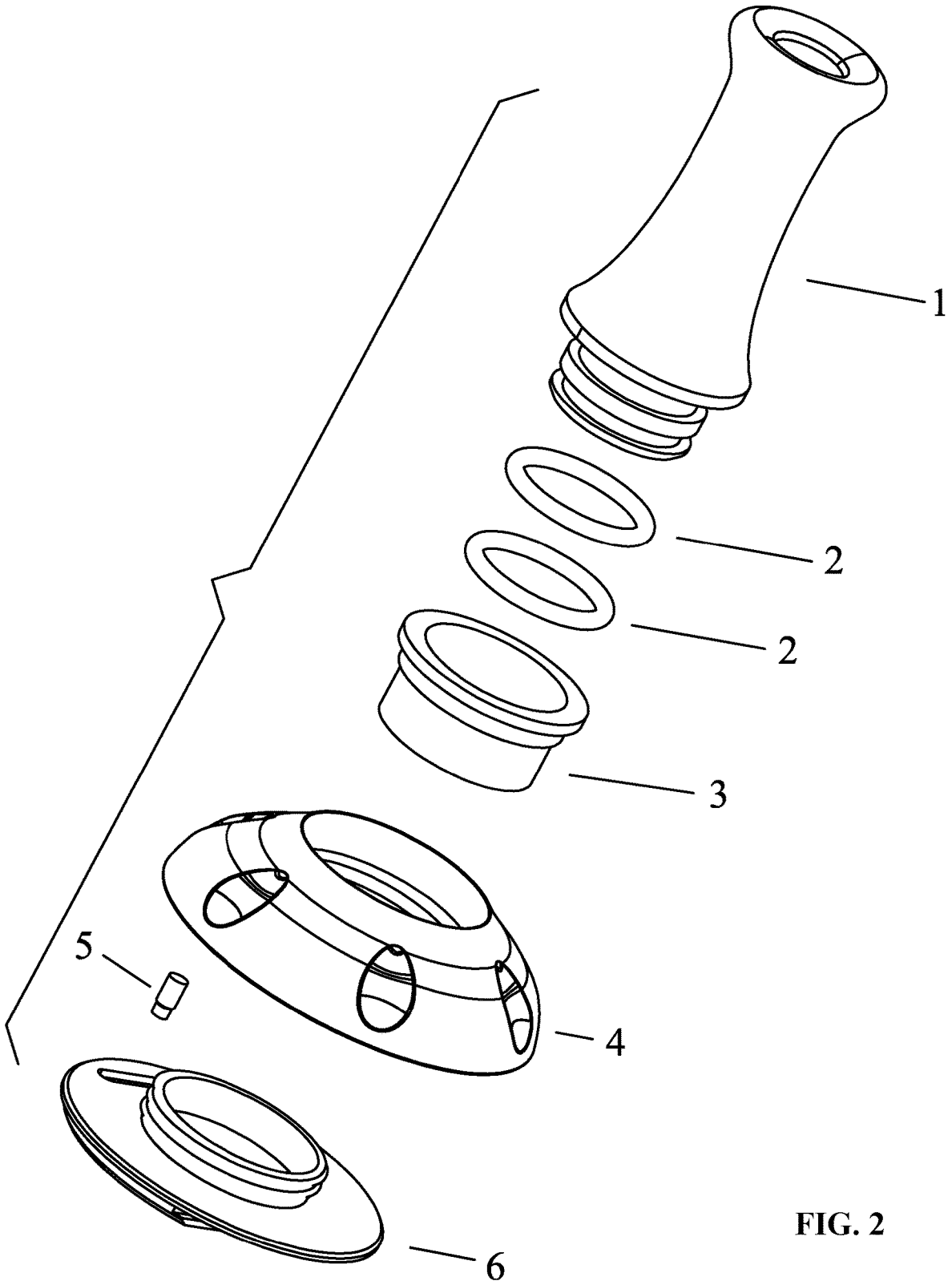
FIG. 2 is an exploded view of a mouthpiece assembly of an electronic cigarette as described in the disclosure
Figure 3:
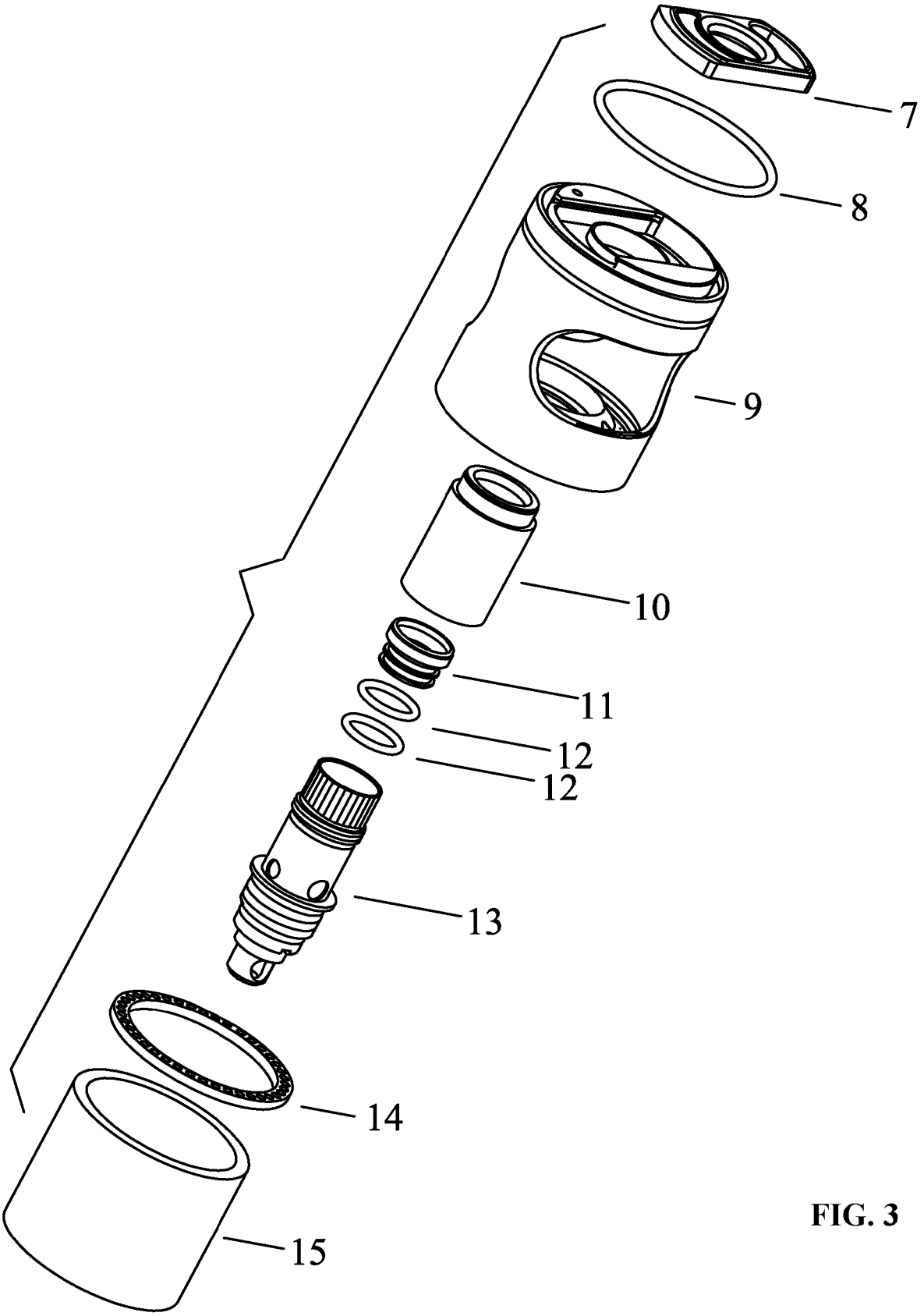
FIG. 3 is an exploded view of an atomizing assembly of an electronic cigarette as described in the disclosure.
Figure 4:
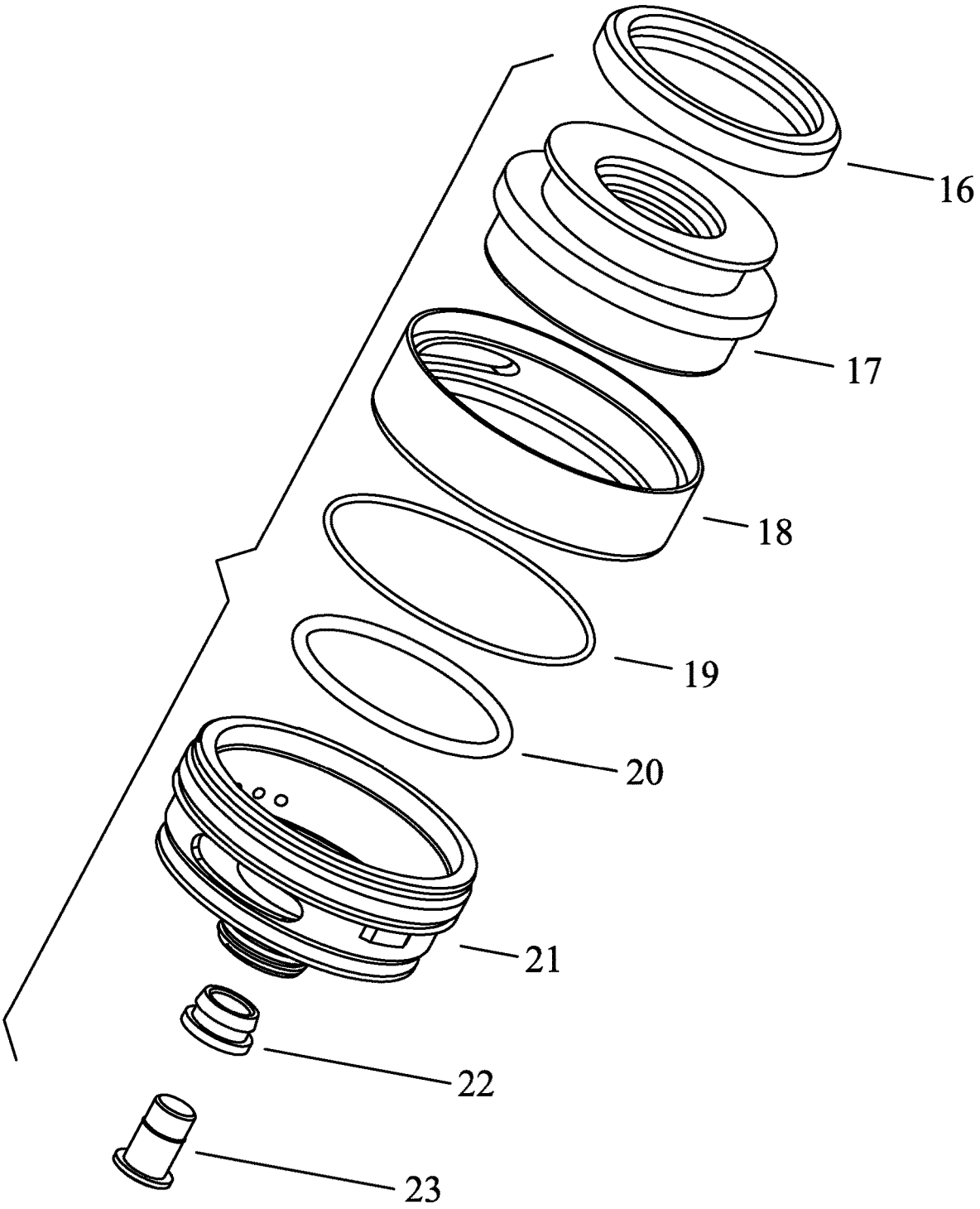
FIG. 4 is an exploded view of a base assembly of an electronic cigarette as described in the disclosure.
Figure 5:
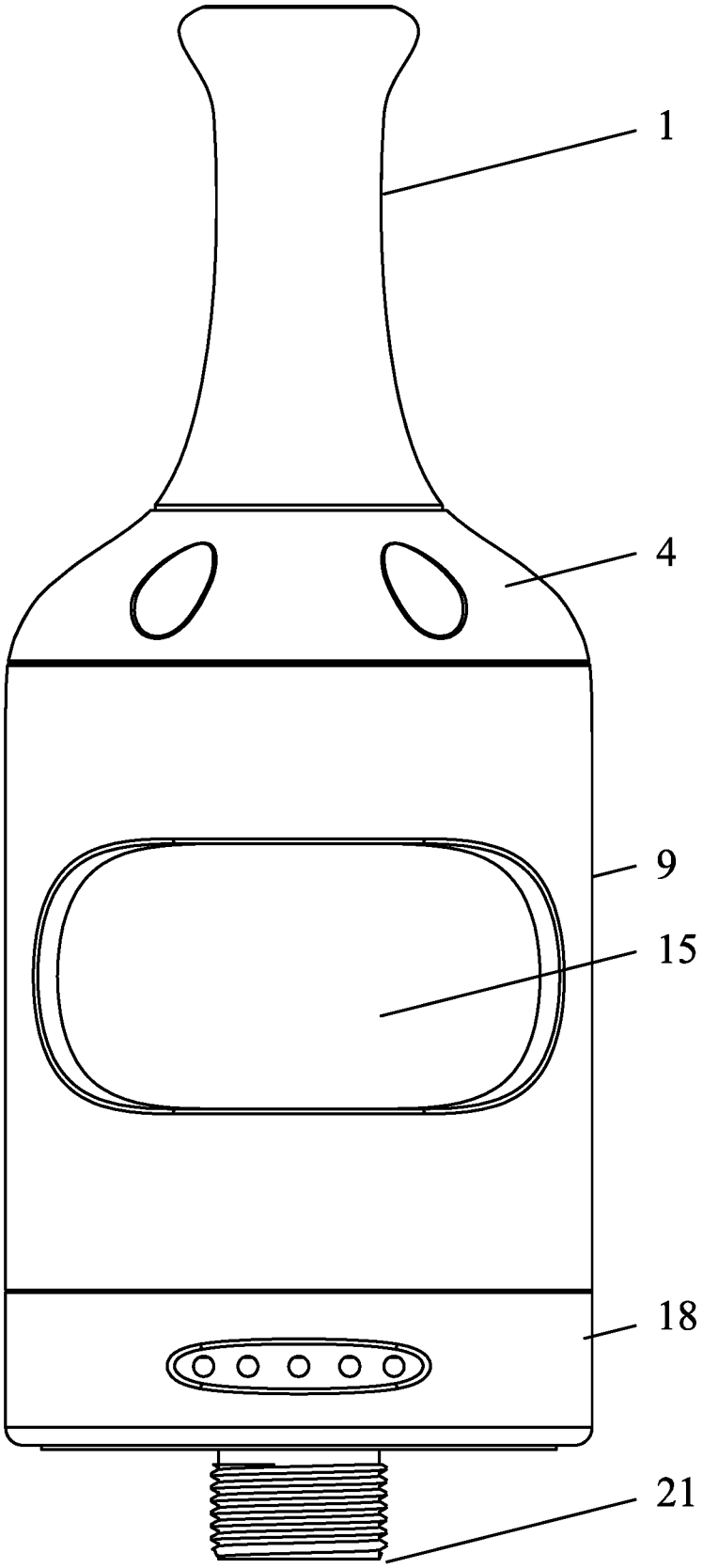
FIG. 5 is a stereogram of an electronic cigarette as described in the disclosure.
Figure 6:
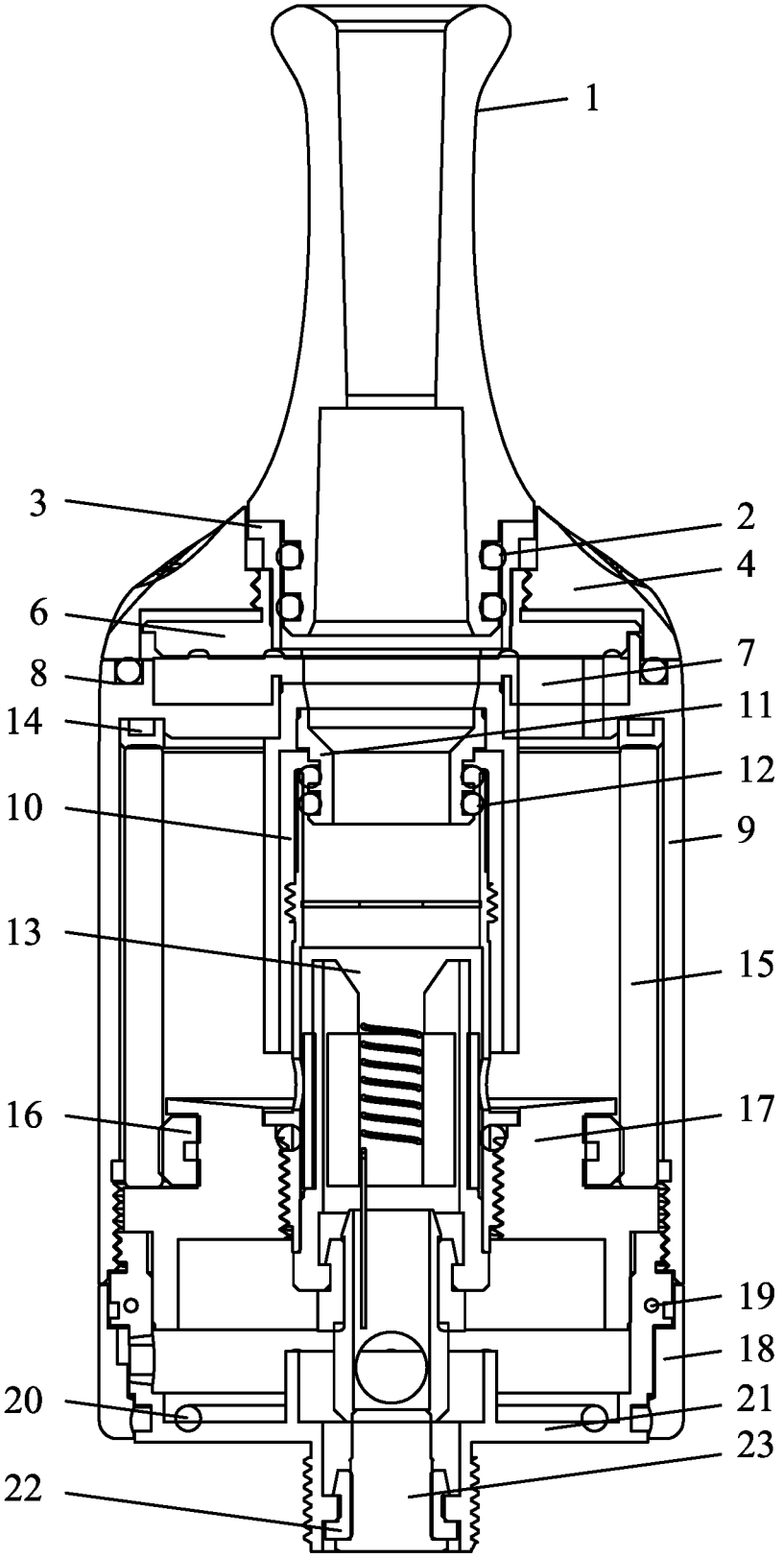
FIG. 6 is a sectional view of an electronic cigarette as described in the disclosure.

As shown in FIGS. 1-6, provided is an electronic cigarette, comprising: a mouthpiece assembly A, an atomizing assembly B, and a base assembly C. The mouthpiece assembly A is disposed on the atomizing assembly B. The atomizing assembly B is disposed on the base assembly C.

The mouthpiece assembly A comprises a mouthpiece 1, a first seal ring 2 adapted to seal the mouthpiece 1, a cylinder 3, a protective cover 4, a pin 5, and a slide block 6. The pin 5 is mounted in the protective cover 4; the first seal ring 2 is sheathed on the mouthpiece 1; the protective cover 4 comprises a central hole and the cylinder is disposed in the central hole; the slide block 6 is embedded in the protective cover 4; the mouthpiece 1 is inserted in the cylinder 3.

The atomizing assembly B comprises a silicone seal 7, a silicone ring 8, a housing 9, a threaded connection ring 10, an atomization unit 13, a sealing element 11 adapted to seal the atomization unit 13, a second seal ring 12 adapted to seal the sealing element 11, a glass tube 15, and a third seal ring 14 adapted to seal an upper part of the glass tube 15. The housing 9 comprises a top surface towards the mouthpiece assembly, and the silicone seal 7 and the silicone ring 8 are disposed on the top surface; the second seal ring 12 is sheathed on the sealing element 11, and the sealing element 11 is disposed in the threaded connection ring 10; the atomization unit 13 is screwed on the threaded connection ring 10; the threaded connection ring 10 is inserted in the housing 9; the glass tube 15 is disposed in the housing 9, and the third seal ring 14 is embedded in the top surface of the housing 9; the top surface of the housing 9 comprises a sliding rail and the slide block 6 is disposed on the sliding rail. The slide block 6 is limited on the top surface of the housing via the pin 5. The protective cover 4 can move up and down along the cylinder 3. To refill the atomization unit 13, the protective cover is pulled up, and the slide block 6 is pushed to one side. The e-liquid inlet of the atomizing assembly is exposed, and the e-liquid can be injected. After refilling, the slide block 6 is pushed back and the protective cover descends to seal the e-liquid inlet. The mouthpiece 1, the protective cover 4, and the housing 9 are of stainless steel.

The base assembly C comprises a fourth seal ring 16 adapted to seal a lower part of the glass tube 15, a support 17 adapted to support the glass tube 16, a vapor regulating ring 18, a base 21, a fifth seal ring 20 adapted to seal the vapor regulating ring 18, a sixth seal ring 19 adapted to seal the base 21, an insulation ring 22, and a joint 23. The fourth seal ring 16 is sheathed on the support 17 to fix and seal the glass tube 15; the fifth seal ring 20 and the sixth seal ring 19 are disposed in the base 21; the vapor regulating ring 18 is disposed on the base 21; a lower part of the support 17 is embedded in the base 21; the insulation ring 22 is sheathed on the joint 23, and the joint 23 is disposed on the base. The support 17, the base 21, the atomization unit 13, and the housing 9 are in threaded connection.

It will be obvious to those skilled in the art that changes and modifications may be made, and therefore, the aim in the appended claims is to cover all such changes and modifications.

What is claimed is:

1. An electronic cigarette, comprising:

a mouthpiece assembly, the mouthpiece assembly comprising a mouthpiece, a first seal ring adapted to seal the mouthpiece, a cylinder, a protective cover, a pin, and a slide block;

an atomizing assembly, the atomizing assembly comprising a silicone seal, a silicone ring, a housing, a threaded connection ring, an atomization unit, a sealing element adapted to seal the atomization unit, a second seal ring adapted to seal the sealing element, a glass tube, and a third seal ring adapted to seal an upper part of the glass tube; and a base assembly, the base assembly comprising a fourth seal ring adapted to seal a lower part of the glass tube, a support adapted to support the glass tube, a vapor regulating ring, a base, a fifth seal ring adapted to seal the vapor regulating ring, a sixth seal ring adapted to seal the base, an insulation ring, and a joint;

wherein:

the mouthpiece assembly is disposed on the atomizing assembly;

the atomizing assembly is disposed on the base assembly;

the pin is mounted in the protective cover;

the first seal ring is sheathed on the mouthpiece;

the protective cover comprises a central hole and the cylinder is disposed in the central hole;

the slide block is embedded in the protective cover;

the mouthpiece is inserted in the cylinder;

the protective cover is flexibly sheathed on the cylinder;

the housing comprises a top surface towards the mouthpiece assembly, and the silicone seal and the silicone ring are disposed on the top surface;

the second seal ring is sheathed on the sealing element, and the sealing element is disposed in the threaded connection ring;

the atomization unit is screwed on the threaded connection ring; the threaded connection ring is inserted in the housing;

the glass tube is disposed in the housing, and the third seal ring is embedded in the top surface of the housing;

the top surface of the housing comprises a sliding rail and the slide block is disposed on the sliding rail;

the slide block is limited on the top surface of the housing via the pin;

the fourth seal ring is sheathed on the support to fix and seal the glass tube;

the fifth seal ring and the sixth seal ring are disposed in the base;

the vapor regulating ring is disposed on the base;

a lower part of the support is embedded in the base; and the insulation ring is sheathed on the joint, and the joint is disposed on the base.

2. The electronic cigarette of claim 1, wherein the mouthpiece, the protective cover, and the housing are stainless steel.

3. The electronic cigarette of claim 1, wherein the support, the base, the atomization unit, and the housing are in threaded connection.

* * * * *